United States Patent [19]

Edgecombe

[11] Patent Number: 5,031,778

[45] Date of Patent: Jul. 16, 1991

[54] SUPPORT ASSEMBLY FOR A HAIR DRYER AND LIKE INSTRUMENTS

[76] Inventor: Vernald Edgecombe, 8225 N.W. 191 St., Unit H, Miami, Fla. 33015

[21] Appl. No.: 493,766

[22] Filed: Mar. 15, 1990

[51] Int. Cl.[5] ..... A47F 13/00

[52] U.S. Cl. ..... 211/13; 211/74; 248/176

[58] Field of Search ..... 211/13, 74; 248/176, 248/117.2, 117.3, 314; 206/581

[56] References Cited

U.S. PATENT DOCUMENTS

| | | | |
|---|---|---|---|
| 1,738,845 | 12/1929 | Rollman | 248/117.3 |
| 3,215,815 | 11/1965 | Lerner | 248/176 X |
| 3,964,708 | 6/1976 | Reeves | 248/126 |
| 4,068,760 | 1/1978 | Johnson, Jr. | 211/74 |
| 4,219,035 | 8/1980 | Deconinck | 211/74 X |
| 4,412,618 | 11/1983 | La Conte | 211/13 X |
| 4,446,972 | 5/1984 | Sussman | 211/13 |
| 4,907,705 | 3/1990 | Waldeck | 211/13 |

*Primary Examiner*—Ramon O. Ramirez
*Attorney, Agent, or Firm*—Malloy, Downey & Malloy

[57] ABSTRACT

A support assembly for a plurality of varied instruments, such as but not necessarily limited to, a blow dryer and a plurality of curling irons wherein the instruments are removably supported on the assembly so as to facilitate access to a handle portion thereof and easy removal and use of the instruments during a hair treating procedure.

11 Claims, 1 Drawing Sheet

FIG. 1
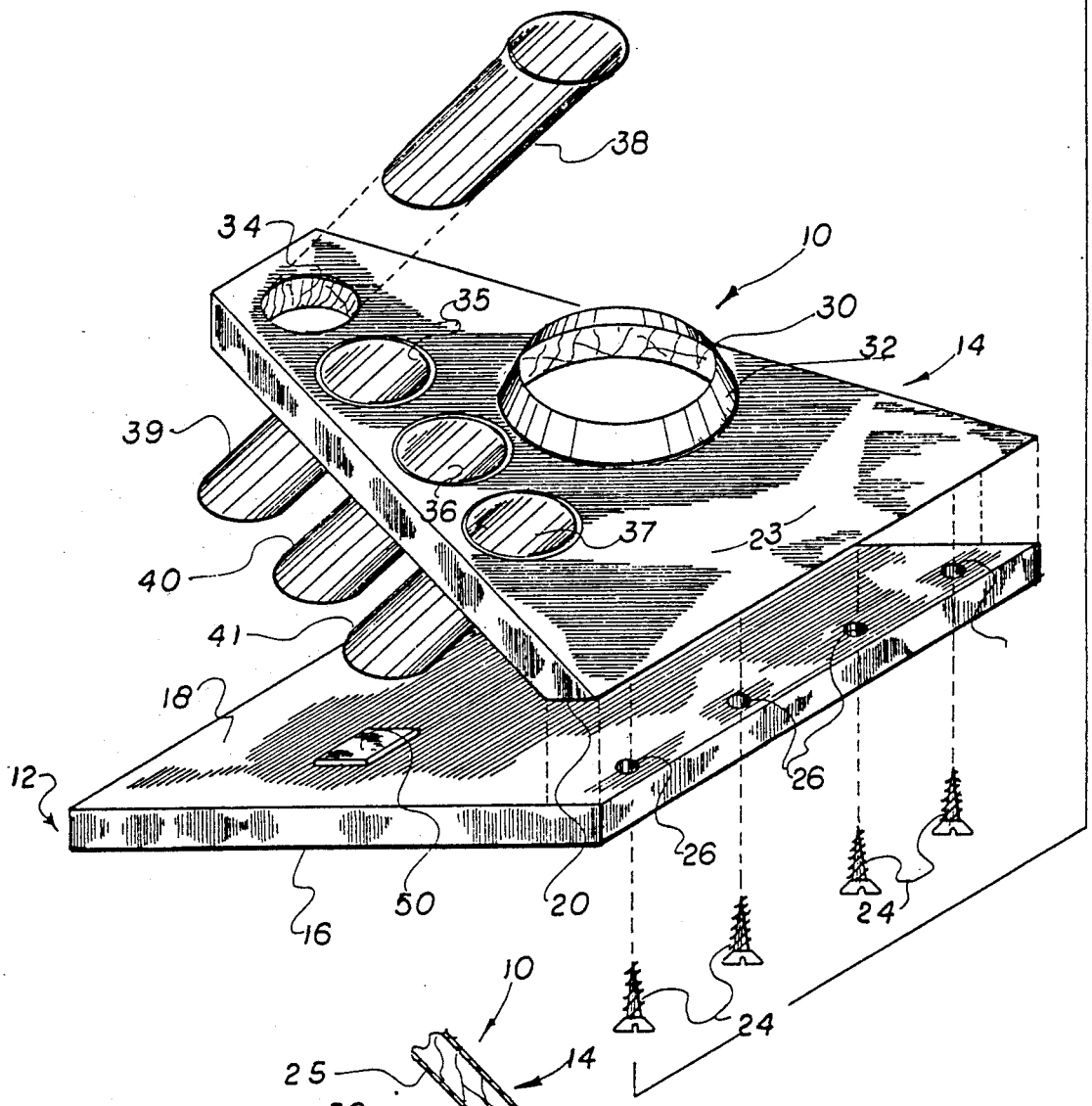
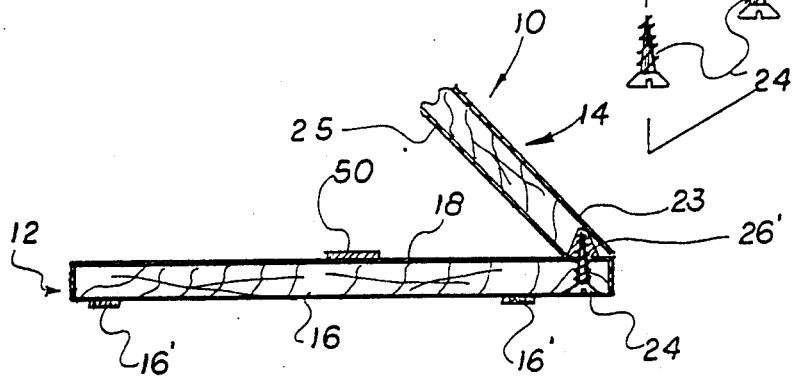
FIG. 2

SUPPORT ASSEMBLY FOR A HAIR DRYER AND LIKE INSTRUMENTS

BACKGROUND OF THE INVENTION

1. Field of the Invention

This invention relates to a support assembly for a hair dryer and like hair treating instruments at a locale and in a manner which facilitates ready access to such instruments during use.

2. Description of the Prior Art

It is common practice for a hair stylist to use a plurality of instruments in the styling of a person's hair. Typically, such instruments include, but of course are not limited to, a hair dryer as well as a plurality of curling irons. In order to facilitate efficient styling of one's hair, curling irons, for example, must be available while they are being heated and must be readily accessible to the operator. Because of the heat generated by such instruments, it is not practical to rest a plurality thereof on a conventional supporting surface such as a desk, tabletop, etc. Such practice is not only dangerous but could result in harm to the supporting surface, table, etc. on which such curling irons are positioned. Similarly, the hair dryer is used repeatedly and therefore, its ready access would greatly facilitate its use as well as reducing time and inconvenience to the operator during the styling process.

The patent to Susmann U.S. Pat. No. 4,446,972 discloses a storage device for a portable hair dryer as well as other instruments and objects. Susmann discloses a plastic injection molded device for storing a hair dryer and other grooming devices having oppositely disposed laterally extending handles provided for lifting and transporting the device and also to serve as a convenient support for wrapping the electrical cord of the dryer in helical terms thereabout. This device is primarily designed for storage and/or transportation of such objects or instruments rather than readily positioning such instruments for immediate use during the styling process. Further, Susmann does not disclose any type of heat resistant mounting or support structure which would enable the disposition of electrically heated instruments, such as curling irons, while they are being utilized and after they have been heated to the desired temperature.

The patent to Hollins, U.S. Pat. No. 3,239,069, discloses a storage or cosmetic rack primarily used for the storage of cosmetic articles and designed to be placed on a normal supporting surface such as a vanity, dresser top or bathroom cabinet. The rack of Hollins includes a plurality of chambers having closed inner ends and open outer ends to provide access to the interior thereof as well as a plurality of elongated ribs formed on an exposed surface thereof. Hollins does not disclose any type of structure which would facilitate the storage and accessible support of a plurality of heated instruments in a manner which renders more efficient the styling process during the use of such instruments.

U.S. Pat. No. 4,412,618 discloses a tray or rack for grooming instruments which is more specifically defined as a receptacle for tools wherein such tools or instruments are maintained in a predetermined orderly arrangement in a position which is readily accessible to the user. There are no structural features associated with this device which allows heated instruments to be stored safely and efficiently such that handle portions thereof are readily accessible to the user or operator to improve the efficiency of the hair designing process when such is undertaken.

While the above set forth prior art devices are representative of attempts to overcome existing problems concerned with this area and while each of the devices are assumed to be operable for their intended function, none of such devices, support racks, etc. are specifically designed to hold heated instruments or other like and varied instruments such as a hair dryer in an operable location which allows the instruments or tools to be readily accessible to the operator while rendering the support and temporary storage of such instruments safe and efficient.

SUMMARY OF THE INVENTION

The present invention relates to a support assembly designed to hold a blow dryer as well as other electrically heated instruments, such as but not limited to hair curling irons, in a position which is readily accessible to a hair stylist or operator while such instruments are being heated intended for immediate use. More specifically, the present invention comprises a base having an undersurface designed to be mounted on a typical support surface such as a dresser, tabletop, counter, etc. in the immediate area where the operator is performing the hair styling process. A support member has one end removably attached to an exposed surface of the base and extends angularly upwardly and outwardly from the exposed surface. A first aperture is formed in the support member and extends therethrough and is transversely dimensioned so as to receive at least the nozzle portion of a conventional handheld hair dryer. The handle portion extends outwardly therefrom in a readily exposed and accessible position to the operator during the designing or styling process In addition, a plurality of second apertures are also integrally formed in the support member and extend therethrough. Each of these apertures preferably include the removable positioning of a sleeve therein. Each of the sleeves have a greater longitudinal dimension than the thickness of the support member. Distal ends of the plurality of sleeves extend outwardly from an undersurface of the support member to add greater stability and support of curling irons or like heated instruments or tools, mounted therein. The sleeves are preferably formed from a metallic material, such as aluminum or other heat resistant material which allows the storage and support of such heated instruments without damaging the material from which the support member is formed. In addition, a shield means may be mounted on at least a portion of the exposed surface of the base in receiving relation to any heated instrument which may have a longitudinal dimension sufficient to normally engage the exposed surface of the base rather than be suspended thereabove. The shield means may comprise a plate fixedly mounted on the exposed surface in receiving relation to one or more instruments passing through one or more of the second plurality of apertures.

Another feature of the present invention is the removable attachment of the support member in the aforementioned angular orientation to the exposed surface of the base. This may occur by an attachment means preferably in the form of a plurality of connectors passing through the base or at least mounted thereon and projecting into one attached end of the support member.

In order to facilitate attachment and detachment of the support member from the base in its operative position, guides are provided in the one attached end of the support member so as to facilitate placement and securement of each of the connectors in their intended interconnecting position between the base and the support member.

In order that the subject support assembly may be readily "broken down" or disassembled, the aforementioned sleeves are also detachable from the respective ones of the second plurality of apertures. In this manner, the various components of the subject support assembly may be packaged in a relatively small compact container or package for shipping, storage or transportation before and after purchase and use by the consumer.

BRIEF DESCRIPTION OF THE DRAWINGS

For a fuller understanding of the nature of the present invention, reference should be had to the following detailed description taken in connection with the accompanying drawings in which:

FIG. 1 is a perspective view in exploded form of a support assembly of the present invention in its operative position.

FIG. 2 is a sectional view showing a plurality of connectors serving to interconnect a base to the support member of the subject assembly.

Like reference numerals refer to like parts throughout the several views of the drawings.

DETAILED DESCRIPTION OF THE PREFERRED EMBODIMENT

With regard to the drawings, the present invention is directed to a support assembly generally indicated as 10 having a base 12 and a support member generally indicated as 14. The base includes an undersurface portion as at 16 designed to be mounted on any type of, preferably but not necessarily, horizontal surface, such as a countertop, table, vanity, etc. The base further includes an exposed surface 18 having the support member 14 attached thereto. More specifically, the support member 14 includes one end as at 20 dimensioned and configured to be attached to the exposed surface 18 and extend upwardly and outwardly therefrom preferably at an angle of less than 90°. Therefore, an exposed surface of the support member as at 23 will be arranged at an incline so as to better facilitate placement of handle portions of a plurality of instruments for ready access by an operator while he is performing a hair styling procedure. Interconnection of the base 12 to the support member 14 occurs by an attachment means preferably defined by a plurality of connectors 24 which may be screw threaded or like conventional connectors passing through or into the interior of the base through a plurality of holes 26 and outwardly therefrom into the one attached end 20 of the support member 14. Such attachment is facilitated by the inclusion of a plurality of connector guides 26' formed in the one end 20 and adapted to receive the outwardly projecting ends of the connectors 24 for inter-engaging attachment of the base 12 to the support member 14. The guides 26' will, therefore, facilitate attachment and detachment of the support member 14 from the base. The various components of the assembly 10 may therefore be arranged in a detached relation to one another to facilitate storage, transportation and packaging when not in use.

The support member 14 includes a first aperture 30 integrally formed in the base and extending completely therethrough. The transverse dimension of the first aperture 40 is such as to allow a nozzle portion of a conventional handheld electrically powered hair dryer to pass therethrough. In such a position, the handle portion of the hair dryer will project outwardly from the exposed front face 23 of the support member 14 for ready access to an operator. In order to prevent damage to the hair dryer or the exposed surface 23 of the support member 14, a cushion means 32 is mounted in surrounding relation to an exposed peripheral edge of the aperture 30. Preferably such cushion means may be in the form of a soft material ring mounted in overlying, covering relation to the normally exposed periphery of the first aperture.

A plurality of second apertures as at 34, 35, 36 and 37 are integrally formed in the support member 14 and extend completely therethrough. A plurality of sleeves 38, 39, 40 and 41 are removably mounted within each of the respective apertures. The longitudinal dimension of each of the sleeves 38 through 41 is greater than the thickness of the support member 14 and accordingly, greater than the length of the second plurality of apertures 34 through 37. Therefore, an outermost end of each of the sleeves protrudes from an undersurface 25 of the support member. Each of these sleeves are dimensioned to receive a curling iron therein. More specifically, the sleeves are dimensioned to receive at least the generally heated portion of the curling iron such that the handle portion thereof projects outwardly from the exposed surface or face 23 of the support member 14. The sleeves 38 through 41 are formed of a heat resistant material such as metal or the like thereby preventing burning or other damage to the support member when the curling irons are heated to their maximum or intended temperature.

The sleeves 38 through 41 are slideably and removably mounted within the plurality of apertures 34 through 37. Accordingly, and outer head portion of each sleeve as at 44 is somewhat enlarged to have a transverse dimension greater than the inner transverse dimension of the plurality of apertures 34 through 37. This prevents passing of the sleeves inadvertently completely through the apertures and maintains them in their operative position as shown in FIG. 1.

A shield means in the form of a heat resistant material plate as at 50 may also be mounted on the exposed surface 18 of the base 12 in a position which will engage a heated tip of at least one of the heated instruments passing through one of the lower most apertures and sleeves as at 37 and 41 respectively. The heated tip will therefore be prevented from doing damage to the exposed surface 18 of the base when heated to its maximum or operative temperature.

It should be emphasized that the subject support assembly 10 is designed to hold numerous other types of instruments other than those specifically delineated. Other structural features may, of course, vary such as the number of first or second apertures and their respective arrangement or orientation relative to one another on the support member 14.

Now that the invention has been described, what is claimed is:

1. A support assembly designed to hold a plurality of different instruments such as a hair dryer and curling iron, said assembly comprising:

a base including an under portion dimensioned and configured to rest on a supporting surface, a support member attached to one longitudinal end of said base on an exposed surface thereof, said one longitudinal end structured and configured to orient said support member in a preferred angular position relative to said base extending upwardly at an angle of less than 90° to said base and the supporting surface on which said base is disposed, a first aperture formed in said support member and extending therethrough and including a transverse dimension sufficient to receive therein a nozzle of a handheld hair dryer, a plurality of second apertures each formed in said support member and extending therethrough and transversely dimensioned to receive and allow passage at least partially therethrough of a handheld curling iron, said support member being positioned in said preferred angular position and said first and second apertures being cooperatively dimensioned and disposed so as to position handle portions of the different instruments within said apertures in a readily accessible orientation so as to facilitate removal thereof from said support member, a plurality of sleeves each mounted within a different one of said plurality of second apertures and configured for supporting engagement with an instrument positioned within respective ones of said second apertures, and shield means mounted on said exposed surface of said base adjacent at least one of said second apertures and dimensioned and disposed to engage a heated end of an instrument passing through and supported within said one second aperture.

2. An assembly as in claim 1 wherein said shield means comprises a heat resistant material plate mounted on said exposed surface in receiving relation to an instrument passing through said one of said second apertures.

3. An assembly as in claim 1 wherein each of said sleeves comprises a sufficient longitudinal dimension to extend through a corresponding one of said second apertures and project outwardly from a rear surface thereof.

4. An assembly as in claim 3 wherein each of said sleeves includes an enlarged end having a transverse dimension greater than a corresponding one of said second apertures in which it is mounted.

5. An assembly as in claim 4 wherein each of said sleeves are transversely dimensioned along a majority of the length thereof to be slideably and removably mounted within one of said second plurality of apertures.

6. An assembly as in claim 1 wherein said plurality of sleeves are formed from a heat resistant material.

7. An assembly as in claim 1 further comprising cushion means mounted on said support member adjacent said first aperture and disposed and structured for projecting an instrument passing through said first aperture.

8. An assembly as in claim 1 further comprising an attachment means structured for removable attachment of said support member to said base.

9. An assembly as in claim 8 wherein said attachment means comprises a plurality of connectors secured to said base and extending into said one end of said support member in connecting engagement therewith.

10. An assembly as in claim 9 wherein said attachment means further comprises a plurality of guides formed in said one end and disposed and dimensioned to receive said plurality of connectors therein.

11. An assembly as in claim 7 wherein said cushion means comprises a soft material ring disposed in surrounding, overlying relation to an exposed peripheral edge of said first aperture.

* * * * *